US009089191B1

(12) United States Patent
Farnum

(10) Patent No.: US 9,089,191 B1
(45) Date of Patent: Jul. 28, 2015

(54) GUITAR PICK FINGER RING WITH REMOVABLE-GUITAR PICK

(71) Applicant: Gerald Martin Farnum, Las Vegas, NV (US)

(72) Inventor: Gerald Martin Farnum, Las Vegas, NV (US)

(73) Assignee: Gerald Martin Farnum, Las Vegas, NV (US)

( * ) Notice: Subject to any disclaimer, the term of this patent is extended or adjusted under 35 U.S.C. 154(b) by 35 days.

(21) Appl. No.: 13/999,303

(22) Filed: Feb. 10, 2014

(51) Int. Cl.
*A44C 9/00* (2006.01)
*G10D 3/16* (2006.01)

(52) U.S. Cl.
CPC ..... *A44C 9/0061* (2013.01); *G10D 3/163* (2013.01)

(58) Field of Classification Search
None
See application file for complete search history.

(56) References Cited

U.S. PATENT DOCUMENTS

| | | | | |
|---|---|---|---|---|
| 1,184,561 | A | 5/1916 | Napoletano | |
| 1,344,500 | A | 6/1920 | Giardino | |
| 1,455,879 | A | 12/1923 | Gronlund | |
| 1,475,974 | A | 12/1923 | Torrey | |
| 1,618,698 | A | 2/1927 | Colon | |
| 1,683,545 | A | 9/1928 | Harris | |
| 1,900,425 | A | 3/1933 | Benjamin | |
| 2,572,889 | A | 10/1951 | Strykower | |
| 2,911,694 | A | 11/1959 | Seron | |
| 2,947,456 | A | 8/1960 | Seron | |
| 2,957,216 | A | 10/1960 | Mule | |
| 3,124,286 | A | 3/1964 | Dompier | |
| 3,326,431 | A | 6/1967 | Belleni | |
| 3,686,894 | A | 8/1972 | Handler et al. | |
| 3,789,720 | A * | 2/1974 | McIntyre | 84/322 |
| 3,894,464 | A | 7/1975 | Brooks | |
| 4,067,255 | A | 1/1978 | Camaioni | |
| 4,137,814 | A | 2/1979 | Rowley | |
| 4,270,433 | A * | 6/1981 | Adamec | 84/322 |
| 4,271,684 | A | 6/1981 | Tisdale | |
| 4,779,778 | A | 10/1988 | Nixon, II | |
| 6,434,805 | B2 * | 8/2002 | Haimoff | 29/10 |
| 6,715,314 | B2 * | 4/2004 | Rose | 63/29.1 |
| 6,797,871 | B2 * | 9/2004 | Atkin | 84/322 |
| 7,799,979 | B2 * | 9/2010 | Swartz | 84/322 |
| 2006/0117931 | A1 * | 6/2006 | Benyahia et al. | 84/322 |

* cited by examiner

*Primary Examiner* — Jack W Lavinder

(57) ABSTRACT

A finger ring for removing yet stably retaining an article commonly known as a guitar pick used for playing a guitar is disclosed.

1 Claim, 4 Drawing Sheets

ENLARGED TOP VIEW

EXPLODED VIEW

ENLARGED TOP VIEW

GUITAR PICK FINGER RING WITH REMOVABLE-GUITAR PICK

BACKGROUND AND SUMMARY OF THE INVENTION

The disclosed invention relates particularly to a finger ring jewelry item that stably yet removably retains an article commonly known as a guitar pick. Musicians often utilize an item such as a plectrum to pick or strum a stringed instrument such as a guitar. When the playing article particularly a small one such as a guitar pick is not attached to the musical instrument itself it can be easily dropped and lost. It is therefore advantageous that the musician has a guitar pick close at hand. This invention affords this advantage quite literally as it is worn on the musicians hand.

DETAILED DESCRIPTION OF THE PREFERRED EMBODIMENTS

Figure 1:
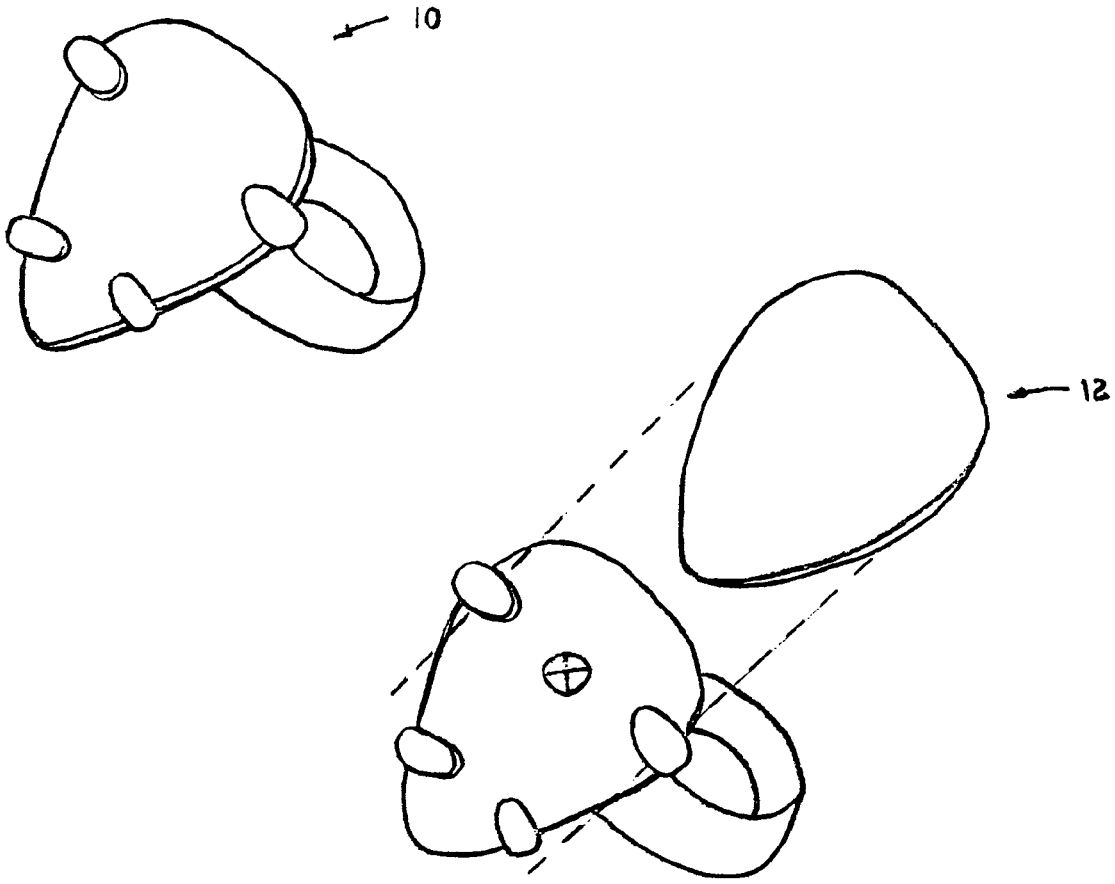
FIG. 1: Is a perspective view of the music article jewelry item with a guitar pick installed and being removed.

Referring to FIG. 1: A perspective view of a music article jewelry item 10 and adjacent to it a perspective of the same music article jewelry item as it relates to the removability of a plectrum commonly known as a guitar pick. The music article jewelry item with the plectrum commonly known as a guitar pick, removed 12. A plectrum commonly known as a guitar pick 12.

Figure 2:
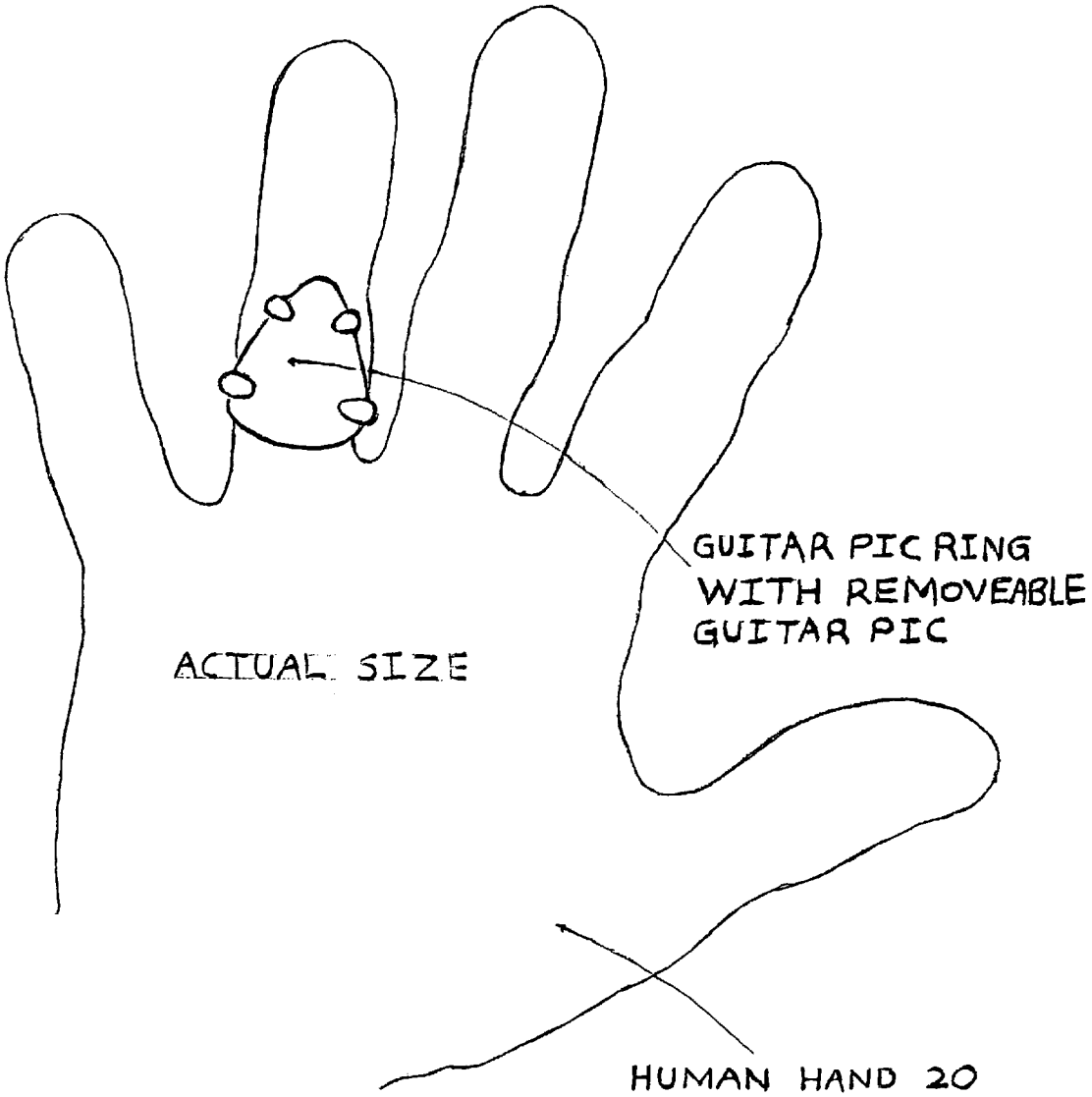
FIG. 2: Is a perspective view of the invention as it relates to being worn on the musicians hand.

Referring to FIG. 2: A perspective view of the music article jewelry item as it relates to a musicians hand 20 illustrated to actual size.

Figure 3:
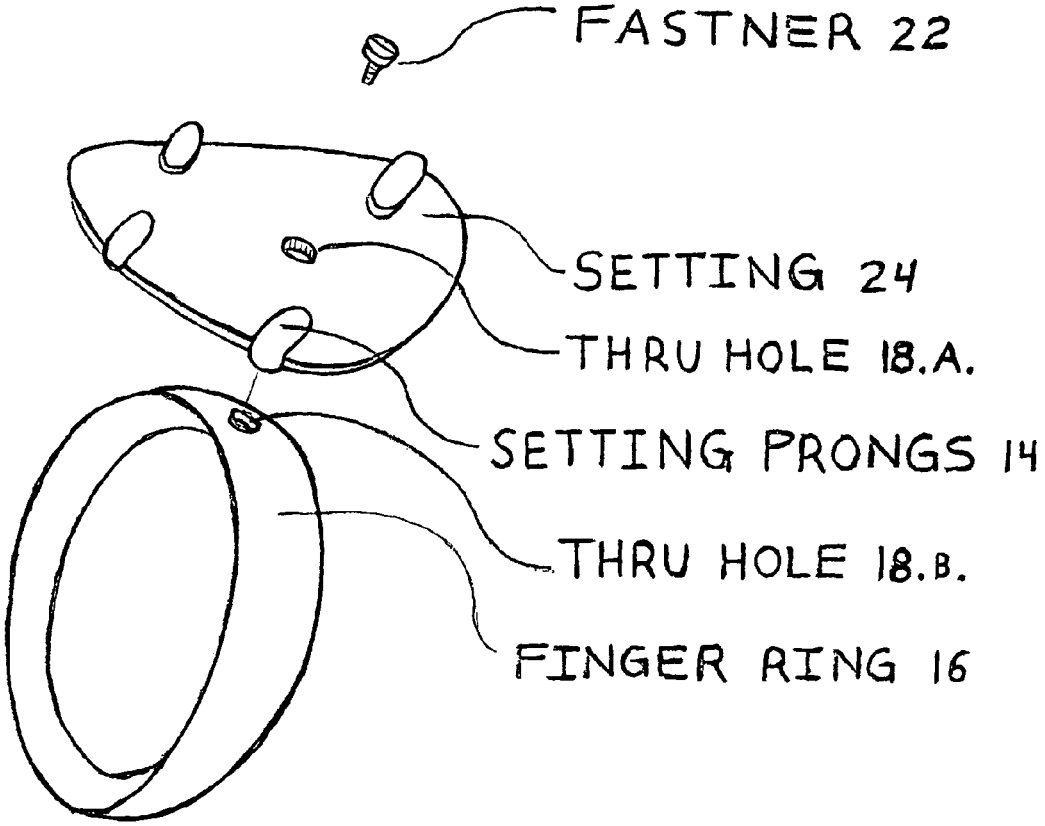
FIG. 3: Is an exploded view of the summary of all the parts of this invention.

Referring to FIG. 3: A perspective exploded view illustrating the parts utilized for the invention such as a common finger ring 16, a setting 24 same size and shape of a plectrum commonly known as a guitar pick. Setting prongs 14 permanently attached to the setting designed to retain the guitar pick. The setting prongs attached to the setting are bent over toward the interior of the setting leaving an open space or commonly known as a gap. The gap which is one thirty second of an inch is sufficient to retain the guitar pick yet render the guitar pick removable.

Figure 4:
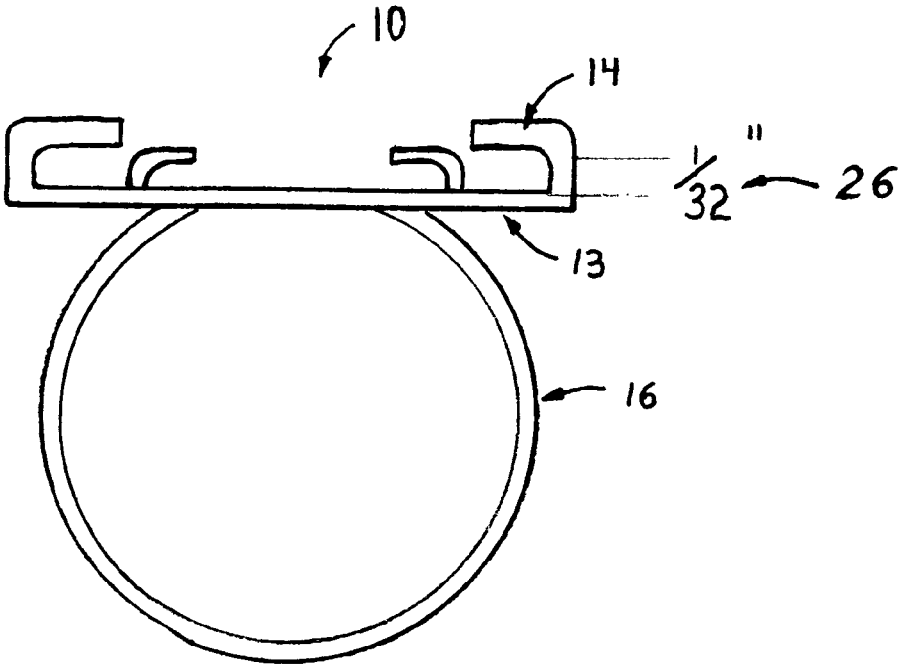
FIG. 4: As an enlarged top view illustrating the utilization of prongs with the setting to stably yet remove and retain a guitar pick.

Referring to FIG. 4: An enlarged top view perspective illustrating the setting prongs 14. The finger ring 16 and the open space or gap between the setting prongs 14 and the face of the setting allowing the guitar pick to be retained yet removable.

I claim:

1. A finger ring for removably holding and displaying a guitar pick having an outer circumferential shape defined by a narrow end and a wider opposed end with opposed sides extending between the ends and a thickness, comprising an annular shank for supporting the finger ring on a finger and a setting attached to an outer surface of said shank for removably receiving said guitar pick; the setting including a base with a shape similar to said outer circumferential shape of said guitar pick including a base narrow end and a base wider opposed end and opposed base sides connecting said base narrow end to said base wider opposed end; said base includes a first and second pair of prongs, said first pair of prongs positioned adjacent said base narrow end with one prong located on one side and the other prong located on the opposed side, and said second pair of prongs positioned adjacent said base wider end with one prong located on one side and the other prong located on the opposed side; each prong includes a first portion attached to said base side and extending upwardly from said base to a height that is slightly greater than said thickness of said guitar pick, and a holding portion that extends a distance substantially parallel to said base and toward the opposing side of said base to define a gap between said holding portion and said base to removably receive and hold said guitar pick; said second pair of prongs are located at the widest distance between said opposed base sides in order to first receive said narrow end of the guitar pick as it is inserted between said second pair of prongs and then to receive and stably hold the widest portion of said guitar pick.

* * * * *